US012601195B2

(12) United States Patent
Joyal Tremblay et al.

(10) Patent No.: US 12,601,195 B2
(45) Date of Patent: Apr. 14, 2026

(54) ADJUSTABLE TOP PLATE DEVICE FOR A JACK POST

(71) Applicants: Etienne Joyal Tremblay, Farnham (CA); Jacques Fornio, Farnham (CA)

(72) Inventors: Etienne Joyal Tremblay, Farnham (CA); Jacques Fornio, Farnham (CA)

( * ) Notice: Subject to any disclaimer, the term of this patent is extended or adjusted under 35 U.S.C. 154(b) by 0 days.

(21) Appl. No.: 18/007,835

(22) PCT Filed: Jun. 2, 2021

(86) PCT No.: PCT/CA2021/000049
§ 371 (c)(1),
(2) Date: Dec. 2, 2022

(87) PCT Pub. No.: WO2021/243437
PCT Pub. Date: Dec. 9, 2021

(65) Prior Publication Data
US 2023/0243169 A1 Aug. 3, 2023

Related U.S. Application Data

(60) Provisional application No. 63/033,430, filed on Jun. 2, 2020.

(51) Int. Cl.
*A47H 13/00* (2006.01)
*E04G 25/06* (2006.01)
*E04G 25/00* (2006.01)

(52) U.S. Cl.
CPC ..... *E04G 25/061* (2013.01); *E04G 2025/006* (2013.01)

(58) Field of Classification Search
CPC ..... E04G 25/061; E04G 2025/006
See application file for complete search history.

(56) References Cited

U.S. PATENT DOCUMENTS 5,924,469 A * 7/1999 Whittemore ..... E04G 21/30 248/200.1
2005/0247414 A1* 11/2005 Whittemore ..... A47H 13/00 160/351
2012/0193591 A1* 8/2012 Huang ..... E04G 25/00 254/100

* cited by examiner

*Primary Examiner* — Amy J. Sterling

(57) ABSTRACT

An adjustable top plate device for a jack post for supporting a top structure when positioned on a floor structure. The adjustable top plate device comprises a plate member, at least one protrusion and an insert body. The plate member defines a top surface for interfacing and/or engaging the top structure and an opposite undersurface for engaging a top plate of jack post The protrusion protrudes from the top surface of the plate member for engaging the top structure and comprises deformable and resilient material. The insert body extends beneath the undersurface of the plate member for being inserted in an opening of the jack post. When the adjustable top plate device is mounted to the jack post, the insert body is inserted within the opening of the rod and the undersurface of the plate member engages the top plate of the rod.

18 Claims, 16 Drawing Sheets

ADJUSTABLE TOP PLATE DEVICE FOR A JACK POST

CROSS-REFERENCE TO RELATED APPLICATIONS

The present application claims priority of U.S. Provisional Patent Application Ser. No. 63/033,430 filed on Jun. 2, 2020 and incorporated herein by reference in its entirety.

TECHNICAL FIELD

The present disclosure generally relates to jack posts. More specifically, but not exclusively, the present disclosure relates to an adjustable top plate device for a jack post.

BACKGROUND

Jack posts are building hardware used in construction. FIG. 1 shows standard jack posts J used to support floors F during construction. These post jacks are telescoping members having a rod R movably extending out of the sleeve S. In this way, the height of the jack post J is adjustable. The bottom end B of sleeve S is positioned on the lower floor F1 and the top end T of the rod R is positioned on the ceiling C of the upper floor F2 undersurface. The jack post J is thus wedged between the floor F1 and the ceiling C. This provides support for upper floors. As shown in FIG. 2, the top end T of the rod R is flat metal plate P and a piece of wood W is screwed onto it. Thus, the top end T of the rod R is either a flat metal plate P or a flat metal plate P with a piece of a wood W mounted thereto by way of a fastener E secured within a hole H at the top end T. Given that ceilings are not perfectly straight in many instances, the jack post J is not tightly wedged between the ceiling C and the floor F2 and as such is in danger of fall off as shown in FIG. 1. FIG. 3 show the jack post J mounted to beams M with a piece of wood W secured to the beam M via a wire Z and a fastener E mounted thereto for being connected to the top end T via hole H. Similar disconnecting dangers with unproperly wedged jack posts J exist here as well.

Objects

An object of the present disclosure is to provide an adjustable top plate device for a jack post.

An object of the present disclosure is to provide a jack post with an adjustable top plate device.

An object of the present disclosure is to provide a kit for jack posts and adjustable top plate devices.

An object of the present disclosure is to provide a method of adjusting jack posts positioned between upper and lower surfaces.

SUMMARY

In accordance with an aspect of the present disclosure, there is provided an adjustable top plate device for a jack post for supporting a top structure when positioned on a floor structure, the jack post having a telescoping rod and sleeve, the rod including a top plate and an opening extending therein, the adjustable top plate device comprising: a plate member defining a top surface for interfacing and/or engaging the top structure and an opposite undersurface for engaging the top plate of the rod; at least one protrusion protruding from the top surface of the plate member for engaging the top structure, the at least one protrusion comprising deformable and resilient material; and an insert body extending beneath the undersurface of the plate member for being inserted in the opening of the rod, wherein when the adjustable top plate device is mounted to the jack post, the insert body is inserted within the opening of the rod and the undersurface of the plate member engages the top plate of the rod.

In an embodiment, the at least one protrusion is positioned at a center portion of the plate member. In an embodiment, the entire top surface of the plate member upwardly protrudes forming the protrusion. In an embodiment, the device further comprises a plurality of protrusions extending from the top surface of the plate member for engaging the top structure, each of the protrusions of the plurality comprising deformable and resilient material. In an embodiment, the at least one protrusion is contiguous with the top surface of the plate member. In an embodiment, the at least one protrusion is a separate body from the top plate member.

In an embodiment, the protrusion is movable relative to the plate member. In an embodiment, the protrusion is biased outwardly relative to the pate member via a biasing member. In an embodiment, the plate member defines a hole for movably positioning the protrusion therethrough. In an embodiment, the protrusion comprises: a protrusion head positioned above the top surface of the plate member; a neck portion downwardly extending from the protrusion head through the hole; and a stem body downwardly extending from the neck portion into the insert body; wherein the neck portion is loosely positioned within the providing for selectively imparting a pivotable, upward, and downward movement thereto within the hole. In an embodiment, the plate member comprises flexible portion defining the hole. In an embodiment, the flexible portion comprises bubble configuration comprising a convex part at the top surface of the plate member, a concave part at the undersurface of the plate member and a void therebetween. In an embodiment, the convex and concave parts comprise deformable and resilient material. In an embodiment, the flexible portion is circumscribed by a recessed area formed in the plate member. In an embodiment, top structure comprises a beam defining a notch with shoulder extending therein, the protrusion head comprising an oblong structure and being pivotable between a position providing a clearance for entering the notch and another position providing for an underside of the protrusion head to rest on the shoulders.

In an embodiment, the protrusion comprises a dome-like shape. In an embodiment, the protrusion is a separate member having a bottom edge thereof resting on the top surface of the plate member. In an embodiment, the protrusion comprises an outer surface thereof and flexible and resilient material underlying the outer surface thereof. In an embodiment, the protrusion is hollow defining an inner surface having a stem body extending therefrom for being fitted within the insert body via a hole formed in the plate member. In an embodiment, the dome-like shape comprises a summit defining a surface contacting area. In an embodiment, the surface contacting area comprises grooves and ridges. In an embodiment, the surface contacting area comprises an additional protruding element being movable relative the dome-like protrusion.

In an embodiment, the rod defines an inner surface circumscribing the opening, the insert body being in a snug contact fit with the inner surface when positioned within the opening.

In an embodiment, the rod defines an inner surface circumscribing the opening, wherein the insert body comprises outwardly extending and outwardly biased deformable, flexible and resilient members for being in a frictional contact fit with the inner surface. In an embodiment, the insert body comprises a clip member comprising the outwardly extending and outwardly biased deformable, flexible, and resilient members.

In an embodiment, the top structure comprises a ceiling, the deformable, flexible and resilient material of the protrusion being resiliently compressible against the ceiling when the adjustable top plate device is mounted to the jack post supporting the ceiling.

In an embodiment, the top surface comprises elongated grooves separated by ridges therebetween.

In an embodiment, the plate member comprises deformable, flexible and resilient material.

In an embodiment, the insert body comprises deformable, flexible and resilient material.

In an embodiment, a biasing element connects the plate member to the insert body providing a biasing force for mutually engagement therebetween, the plate member and the insert body being separate bodies movable from each other against the biasing force of the biasing element to provide a space therebetween. In an embodiment, the rod defines an inner surface circumscribing the opening, wherein a portion of the inner surface inwardly protrudes into the opening, the plate member and the insert body providing for clamping the inner surface portion when fitted in the space therebetween due to the biasing force.

In an embodiment, the device comprises an integral single piece of flexible and resilient material.

In accordance with an aspect of the disclosure, there is provided a jack post comprising the adjustable top plate devices provided herein.

In accordance with an aspect of the disclosure, there is provided a kit comprising a plurality of the adjustable top plate devices provided herein.

In accordance with an aspect of the disclosure, there is provided a kit comprising a plurality of jack posts and a plurality of the adjustable top plate devices provided herein.

In accordance with an aspect of the disclosure, there is provided a method for supporting a top structure with a jack post comprising positioning the adjustable top plate device provided herein to the ceiling structure and mounting the adjustable top plate device to the jack post.

Other objects, advantages and features of the present disclosure will become more apparent upon reading of the following non-restrictive description of illustrative embodiments thereof, given by way of example only with reference to the accompanying drawings.

DETAILED DESCRIPTION OF ILLUSTRATIVE EMBODIMENTS

Generally stated and in accordance with an aspect of the present disclosure, there is provided an adjustable top plate device for a jack post for supporting a top structure when positioned on a floor structure. The jack post has a telescoping rod and sleeve. The rod includes a top plate and an opening extending therein. The adjustable top plate device comprises a plate member, at least one protrusion and an insert body. The plate member defines a top surface for interfacing and/or engaging the top structure and an opposite undersurface for engaging the top plate of the rod. The protrusion protrudes from the top surface of the plate member for engaging the top structure and comprises deformable and resilient material. The insert body extends beneath the undersurface of the plate member for being inserted in the opening of the rod. When the adjustable top plate device is mounted to the jack post, the insert body is inserted within the opening of the rod and the undersurface of the plate member engages the top plate of the rod.

Figure 1:
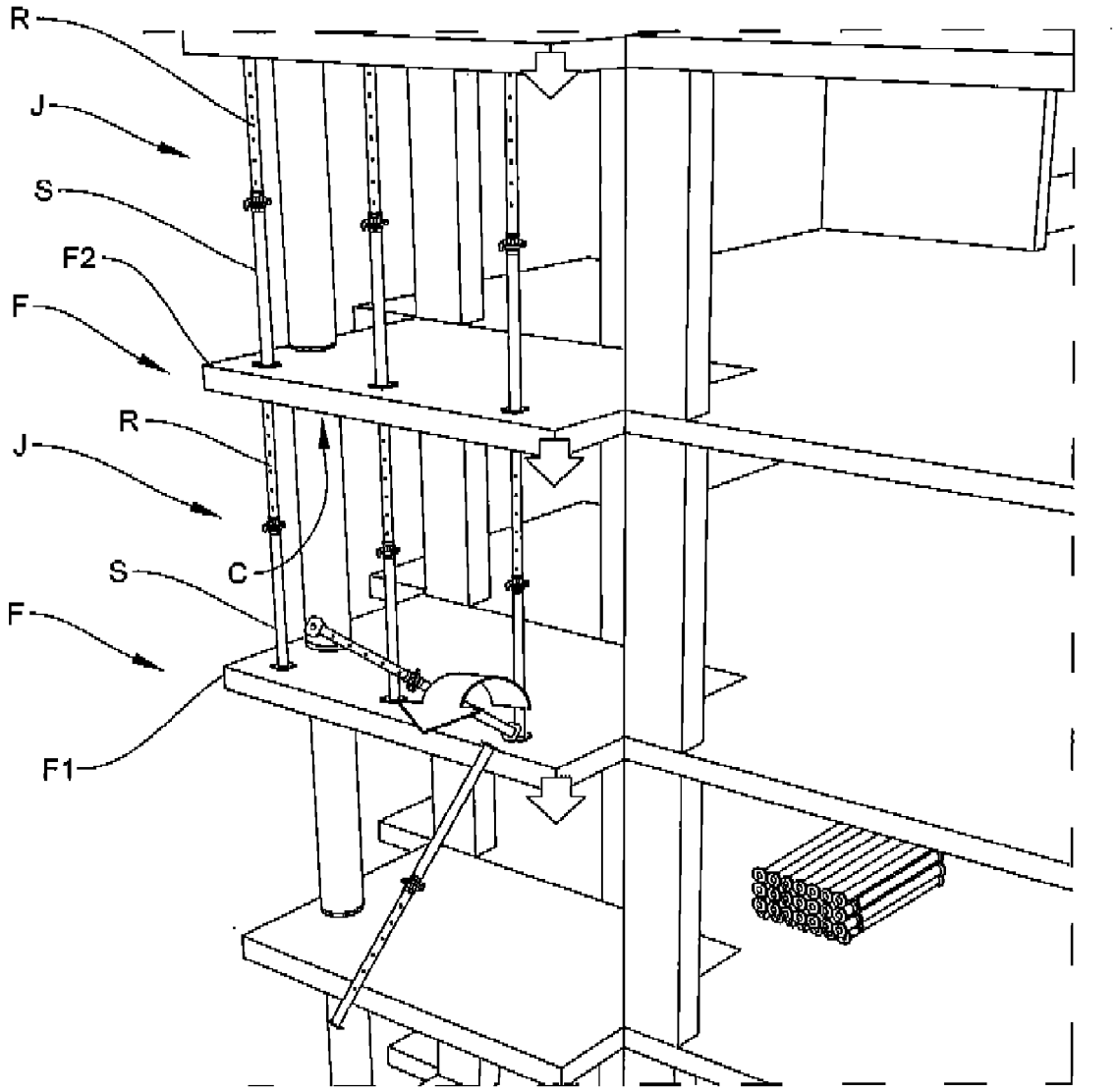
FIG. 1 (PRIOR ART)
FIG. 1 is a perspective view of a plurality of prior art jack posts positioned between upper and lower floors in a building during construction thereof.
Figure 2:
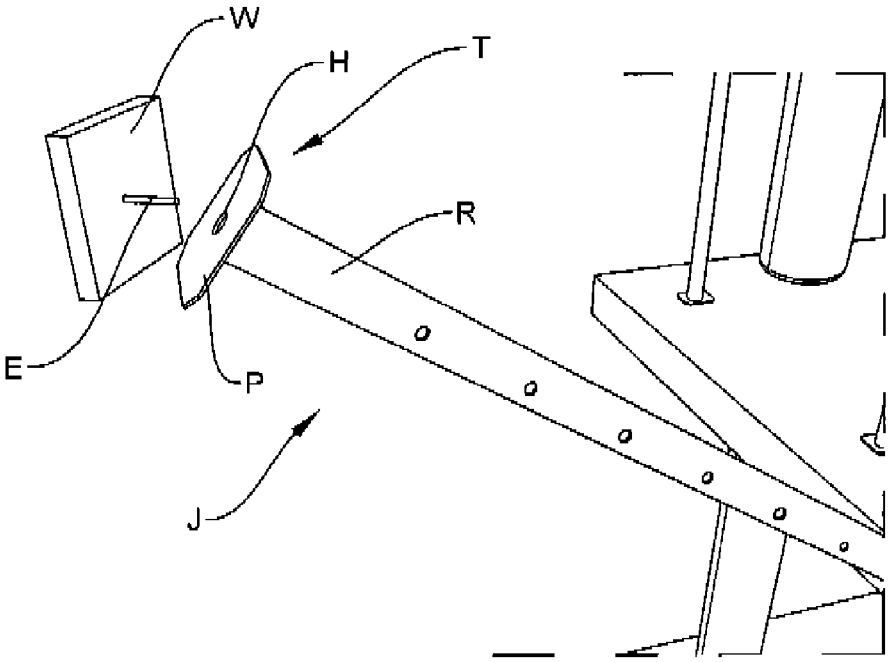
FIG. 2 (PRIOR ART)
FIG. 2 is a perspective view of a top end of a prior art jack post.
Figure 3:
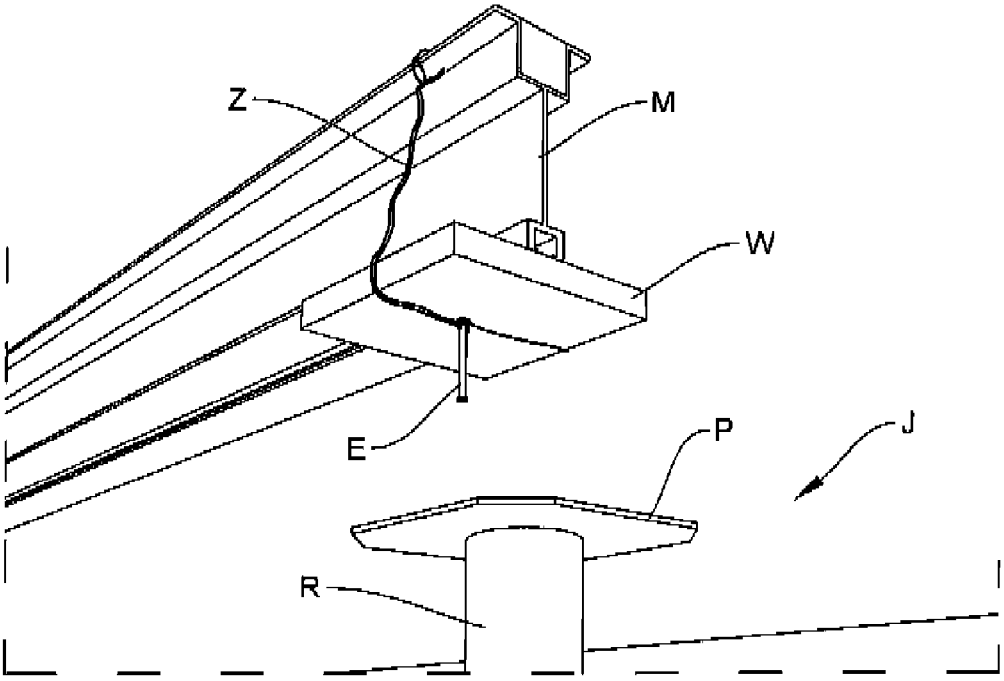
FIG. 3 (PRIOR ART)
FIG. 3 is a perspective view of a top end of a prior art jack post mounted to a beam.
Figure 4:
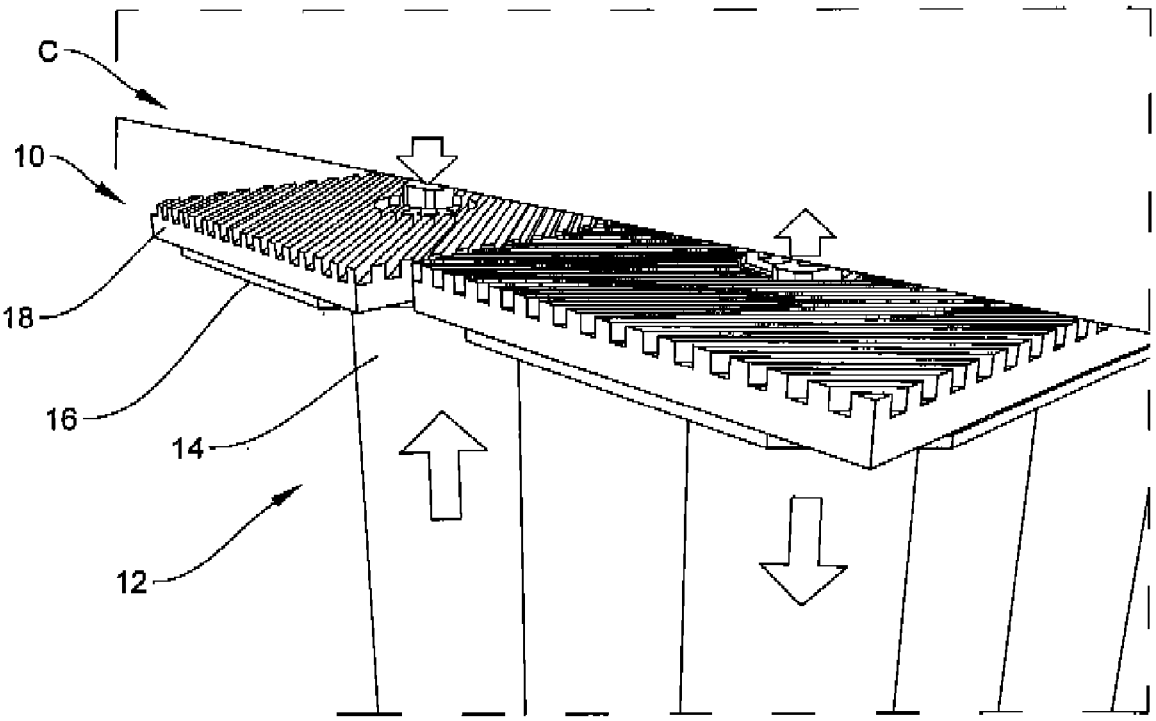
FIG. 4 is a perspective top end view the jack posts with adjustable top plate device in accordance with a non-restrictive illustrative embodiment of the present disclosure.

With reference to FIGS. 4 to 8, there is shown an adjustable top plate device 10 for being mounted to a jack post 12 (shown in FIG. 4). The jack post 12 is similar to standard jack posts and as such includes a rod 14, a top plate 16 and hole opening at the top plate and extending inwardly into the rod 14. The device 10 includes a plate member 18 made, a central portion 20 thereof through which a movable protrusion 22 extends from and a lower insert body in the form of a sleeve 24 in this example downwardly extending from the plate member 18.

The plate member 18 is provided in rectangular configuration similar to the top plate 16 but of course other geometric configurations can be contemplated within the scope of the present disclosure. The plate therefore defines a top surface 26, a bottom surface 28 and lateral edges 30A, 30B, 30C and 30D. The top surface 26 includes a plurality of longitudinal grooves 32 across the surface thereof from edge to edge providing openings 34 at the edges 30A, 30B, 30C and 30D. The bottom surface 28 is positioned on the top plate 16.

Figure 5A:
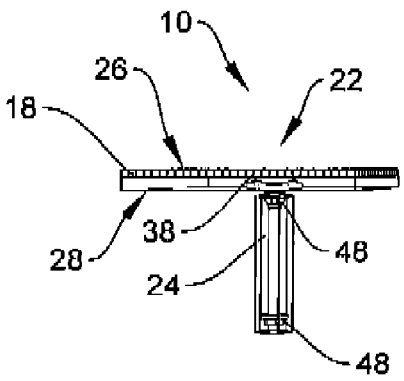
FIGS. 5(A), 5(B) and 5C show the adjustable top plate device of FIG. 4 in respective pivot positions.
Figure 5B:
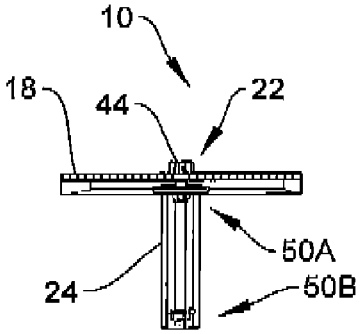
Figure 5C:
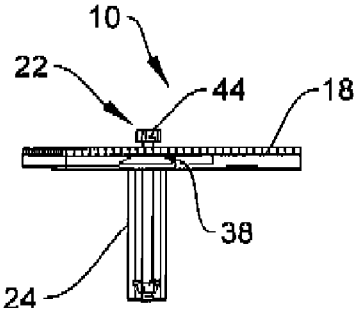
Figure 6:
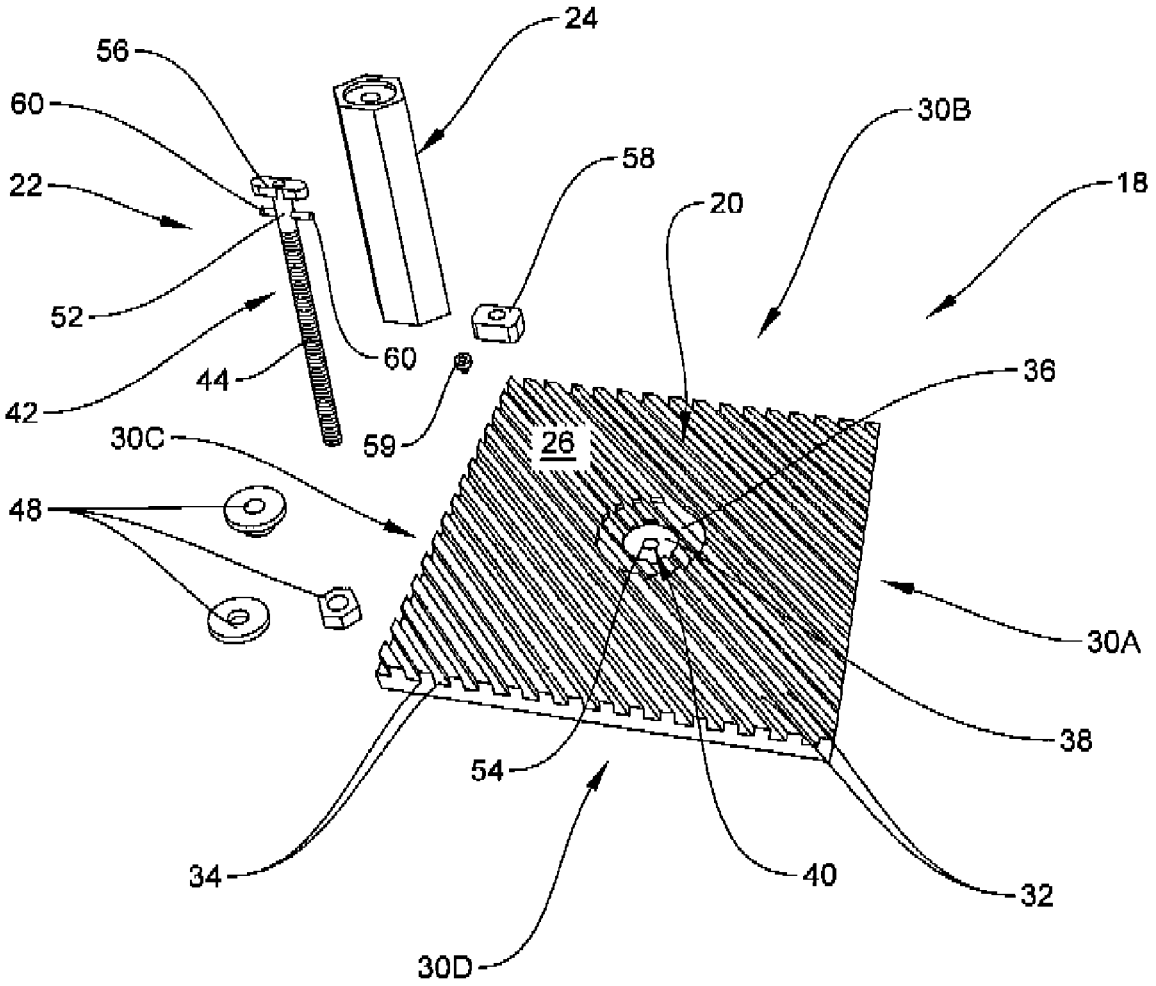
FIG. 6 is a disassembled perspective view top plate device of FIG. 4.

The central portion 20 includes a circular recessed area 36 recessed from the top surface 26 and thus forming a slight cavity. The recessed area 36 includes a flexible portion 38 circumscribing a hole 40 formed through the plate member 18. The flexible portion 38 is made of thinner material than the rest of the recessed area and does not include the grooves 32 and thus has a flat surface as shown. The flexible portion 38 is upwardly and downwardly flexible as shown in FIGS. 5A to 5C. Indeed, in FIG. 5A, the flexible portion 38 is flexed in a downward position towards the bottom surface 28, whereas in FIG. 5C, the flexible portion 38 is an upwardly flexed position towards the top surface 26. FIG. 5B shows the flexible portion 38 in a neutral or median position between the upwardly flexed and downwardly flexed positions aligned with the lateral edges 30A, 30B, 30C and 30D.

The movable protrusion 22 is positioned though the hole 40 and includes a stem body 42 and a protrusion head 44 positioned above the hole 40 with most of the stem body 42 positioned beneath the hole 40. In this way, the movable protrusion 22 is movable inwardly and outwardly along with the flexible portion 38. FIGS. 5A and 5C shown the protrusion head 44 in the most inward and most outward position respectively and FIG. 5C shows the protrusion head 44 in an intermediate position therebetween.

The stem body 42 has a longer threaded portion 46 thereof that is fitted withing the sleeve 24 which includes integral connected threaded nuts 48 at the top and bottom ends thereof, namely ends 50A and 50B respectively for fastening the stem body 42 thereto. The stem body 42 includes a non-threaded neck portion 52 positioned between the threaded portion 46 and the head 44. The neck portion 52 slidably and loosely engages the inner edge 54 forming the hole 40 and as such can slide upwardly and downwardly relative inner edge 54. The engagement of the inner edge 54 with the neck portion 52 provides movement of the flexible portion 38 as previously described along with the movement of the neck portion 52 as it is dragged thereby.

The user can thus move the head 44 as shown in FIGS. 5A to 5C, by pushing the sleeve 24 coupled to the protrusion 22 upwardly or pulling it downwardly.

The head 44 comprises an oblong structure 56 covered by hood 58 fastened thereto via fastener 59. In an embodiment, the hood 58 comprises deformable, flexible and resilient material. In a non-limiting example, the hood 58 comprises rubber material. The neck portion 52 includes sideguard fins 60 extending therefrom which are positioned beneath the flexible portion 38. In this way, the protrusion 22 is not disassociated from the plate member 18, as the undersurface 62 of the oblong structure 56 engages the flexible portion 38 at the top surface 26 thereof and the sideguard fins 60 engage the flexible portion 38 at the top surface 28 thereof preventing the protrusion 22 from going fully through the hole and also pushing or pulling the flexible portion 38 along with the movement of the coupled protrusion 22 and sleeve 24.

The user can rotate the sleeve 24 to rotate the position of the oblong configured head 44 depending on the use thereof.

Turning to FIG. 4, the user positions the adjustable plate devices 10 within a respective jack 12 by inserting the insert body 24 within the tubular rod 13 of the jack 12 with the plate member 18 resting on the top plate 16 of the jack 12. The head 44 of the protrusion and the top face 26 of plate member 18 being made of deformable, flexible and resilient material is compressible (and biased against compression) so as to be squeezed or wedged between the top plate 16 and the ceiling C, the head 44 makes up for any gap between the ceiling C and the top face 26 providing a tight tension and friction fit of the jack 12 between a floor and the ceiling 12 and avoiding a loose or weak point of contact with the ceiling which will cause the jack 12 to fall as previously explained.

Figure 7:
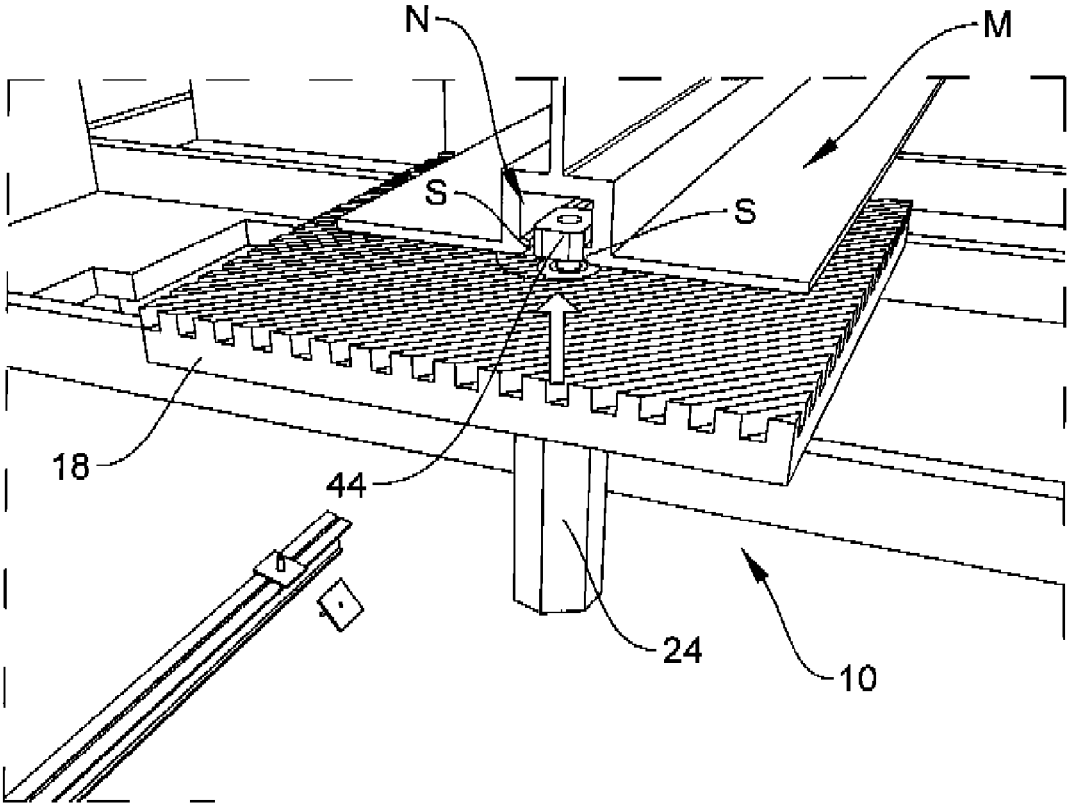
FIG. 7 is top, perspective view of the top plate device of 4 mounted to a beam in one pivot position.
Figure 8:
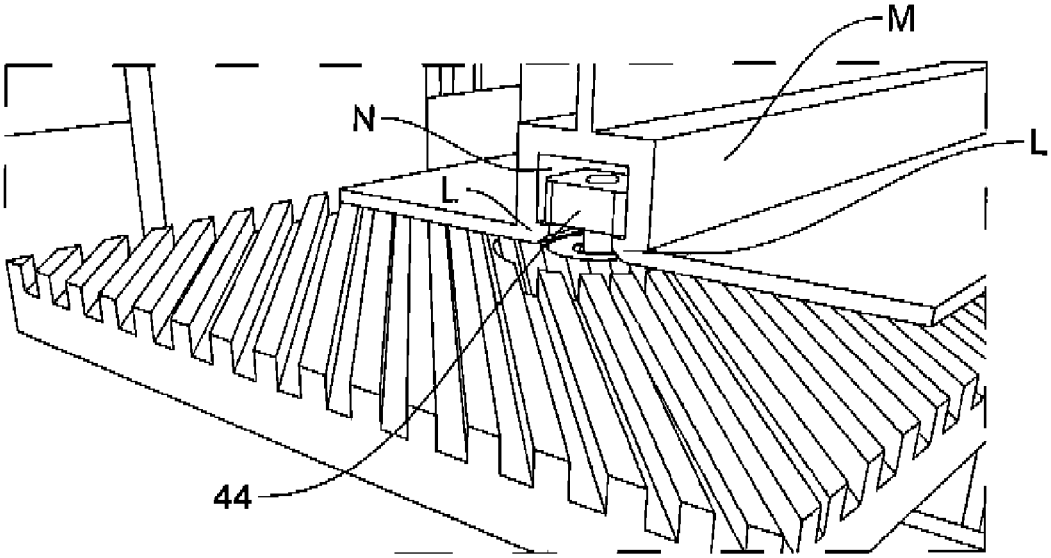
FIG. 8 is top, perspective view of the top plate device of 4 mounted to a beam in another pivot position.

Turning to FIGS. 7 and 8, the device 10 is shown mounted to a beam M which include a notch N forming shoulders L. The user inserts the oblong shaped head 44 within notch N when the head 44 is in a pivot position that is clear of interfering with the shoulders L as shown in FIG. 7. Once, the head 44 is inserted in notch N, the user turns the sleeve 24 to pivot the head 44 that provides the underside thereof to rest on the shoulders L as shown in FIG. 8. The user then connects the jacks 12 to the hanging devices 10 by inserting the sleeve insert body 24 therein as previously described.

Turning now to FIGS. 9 to 14, an adjustable top plate device 10' for a jack post 12 will now be described in accordance with a non-limiting illustrative embodiment of the present disclosure.

The device 10' includes a plate member 18' and an insert body downwardly 24' extending from the plate member 18'.

With particular reference to 11(A), 11(B) and 11(C), there is shown a plate 18' comprising a central portion 20' including a circular recessed area 36A' recessed from top surface 26' and thus forming a slight cavity and a circular recessed area 36B' (see FIG. 10) recessed from the bottom or undersurface 28' and The recessed area 36' includes a flexible portion 64 circumscribing a hole 40' formed through the plate member 18'. The flexible portion 64 is a bubble member. The flexible bubble portion 64 has a top convex part 66A and a lower concave part 66B forming a void space 68 therebetween circumscribed by the common inner edge 70 at the junction between the parts 66A and 66B. The parts 66A and 66B have respective aligned holes 72A and 72B. Bubble parts 66A and 66B include respective reinforcement rings 74A and 74B respectively circumscribing holes 72A and 72B. The holes 74A and 74B provide for positioning a protrusion 22' therethrough similar to the way protrusion 22 is received through single hole 40 and as will be further described herein.

Figure 9:
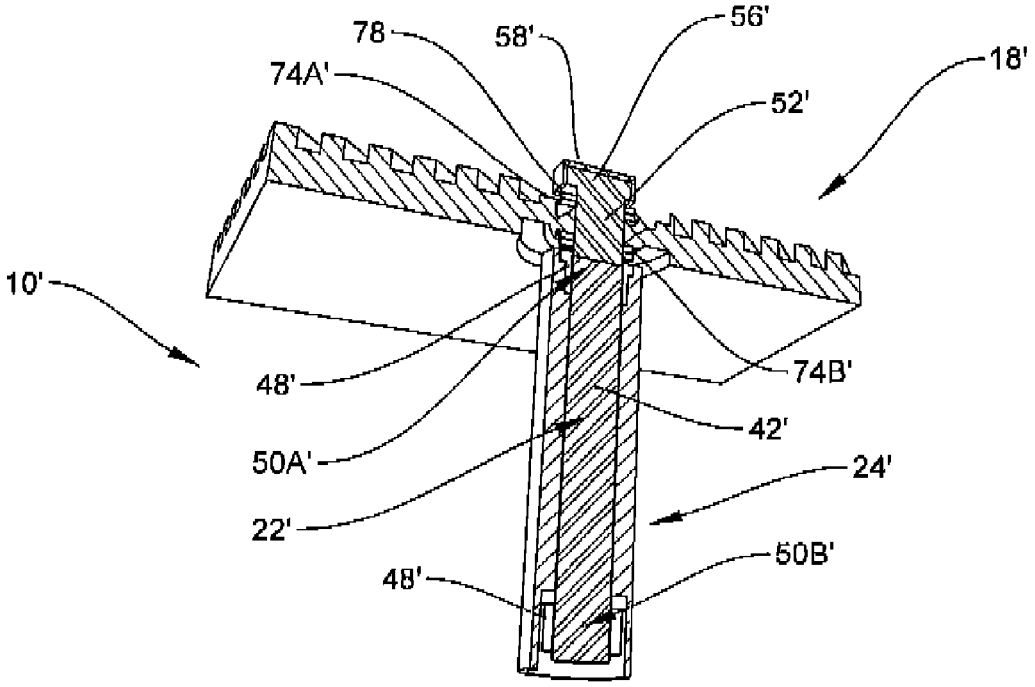
FIG. 9 is a bottom, front and sectioned perspective view of a top plate device for a jack post in accordance with another non-restrictive illustrative embodiment of the present disclosure.
Figure 10:
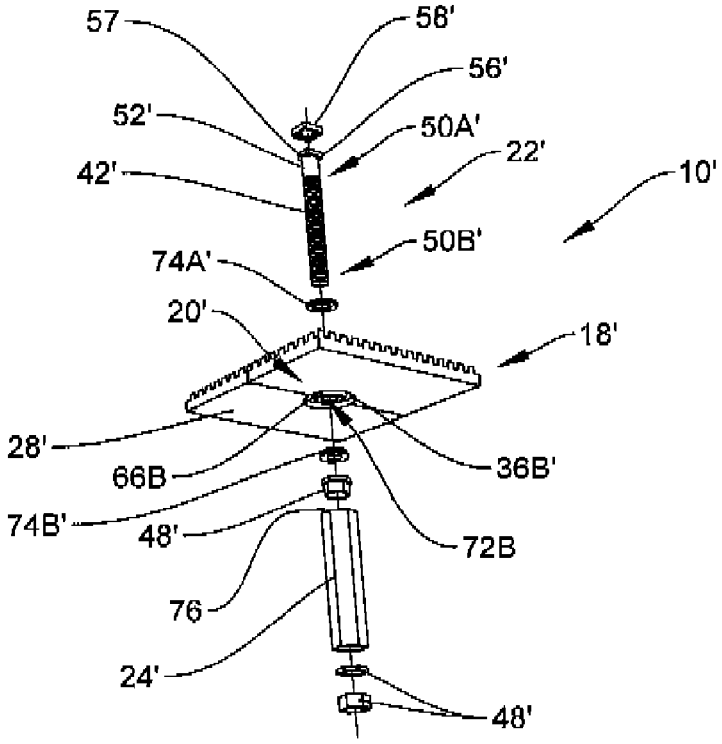
FIG. 10 is a, bottom, front and exploded perspective view the adjustable top plate device of FIG. 9.
Figure 11A:
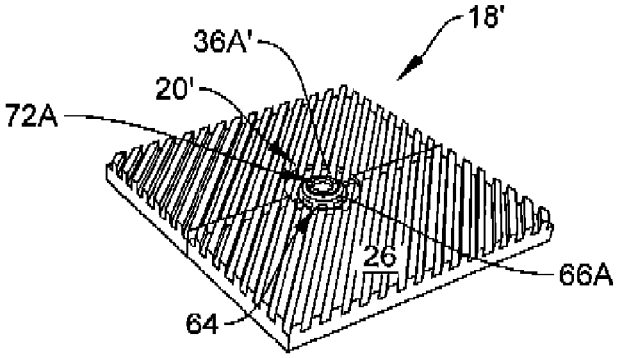
FIG. 11(A) is a top, perspective view of the plate member of the adjustable top plate device of FIG. 9.
Figure 11B:
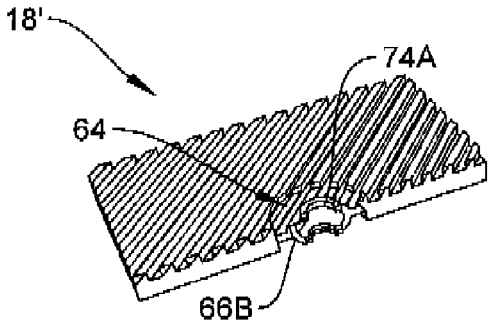
FIG. 11(B) is a top and sectioned perspective view of the plate members of FIG. 11(A)
Figure 11C:
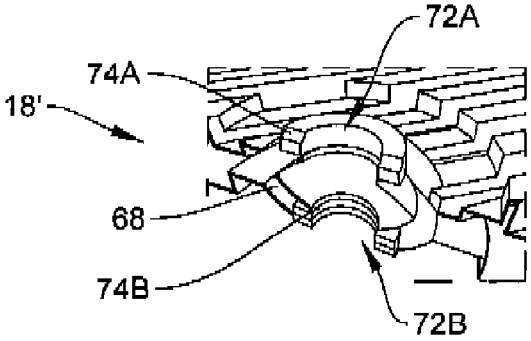
FIG. 11(C) is an enlarged view of a portion of FIG. 11(B)
Figure 12:
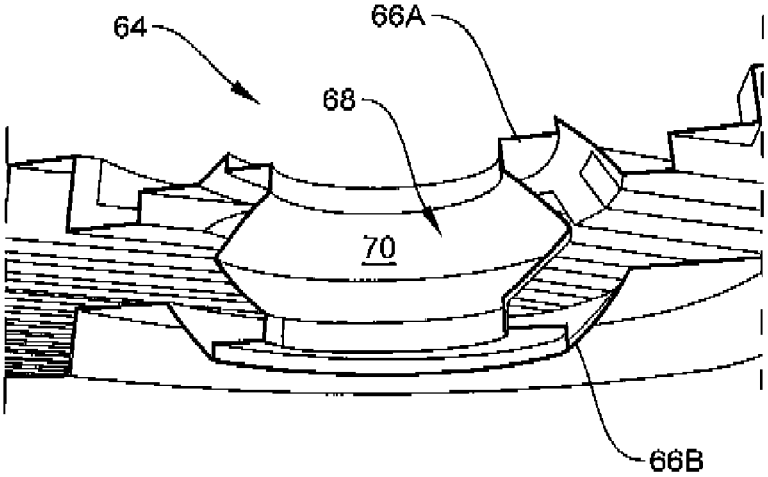
FIG. 12 is an enlarged, front, perspective and disassembled view of the portion of FIG. 11(C)

Turning to FIGS. 9 and 10, the device includes a coupled protrusion 22' and insert body 24' which acts as a sleeve for the protrusion 22'.

The protrusion 22' comprises a stem body 42' extending beneath the plate member 18' within the insert body 24' and being fixed to the insert body 24' at top and bottom ends, 50A' and 50B' via nut and bolts 48' within the body 24'. The protrusion 22' includes a neck portion 52' upwardly extending from the stem body 42' and positioned through holes 72A and 72B extending within the void space 68 and connected to the head 44' which is positioned above the plate member 18' to selectively rest on bubble part 66A when not upwardly pushed. The neck portion 52' may engage the rings 74A and 74B but is otherwise loosely positioned the aligned holes 72A and 72B. The head 44' comprises an oblong inner structure 56' covered by hood 58'.

The coupled protrusion 22' and insert body 24' can be selectively pushed upwardly or pulled downwardly (such as via pressure from a ceiling for example). When pushed upwardly the top edge 76 of the insert body 24' beneath the neck portion 52' engages the bottom concave bubble part 66B pushing it inwardly against its outward biased force. When the protrusion is pushed or pulled downwardly, the undersurface edges 78 of the head 44' engage the top convex bubble part 66A pushing it inwardly against its outward biased force.

The bubble structure of the flexible portion 64 and the void space 68 provide for increasing the durability of the flexible portion 64. This durability is further increased by the reinforcement rings 74A and 74B. The convex part 66A is upwardly biased and can lift a head 44' upwardly as well as being compressible when under sufficient stress between a jack top plate 16 and a ceiling C as previously described.

In an embodiment, the flexible portion 64 does not include reinforcement rings of any kind.

Figure 13:
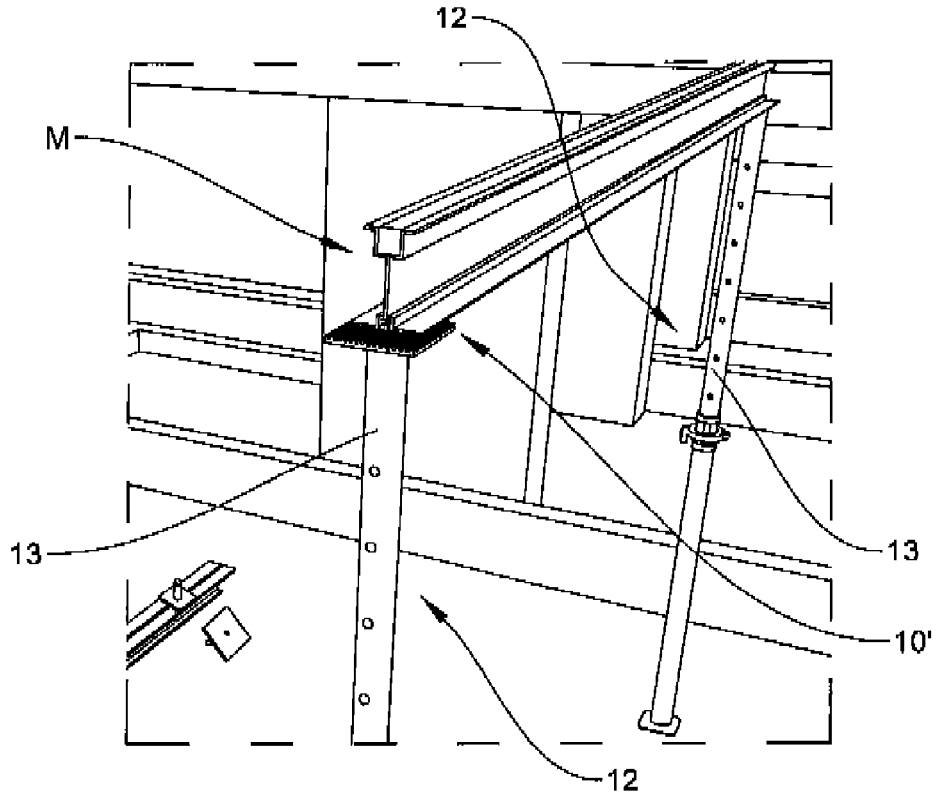
FIG. 13 is a top, perspective view of jack posts comprising the adjustable top plate device of FIG. 9 mounted to a beam.

FIG. 13 shows jack posts 12 including the device 10' for supporting a beam M.

Figures 14A, 14B, 14C:
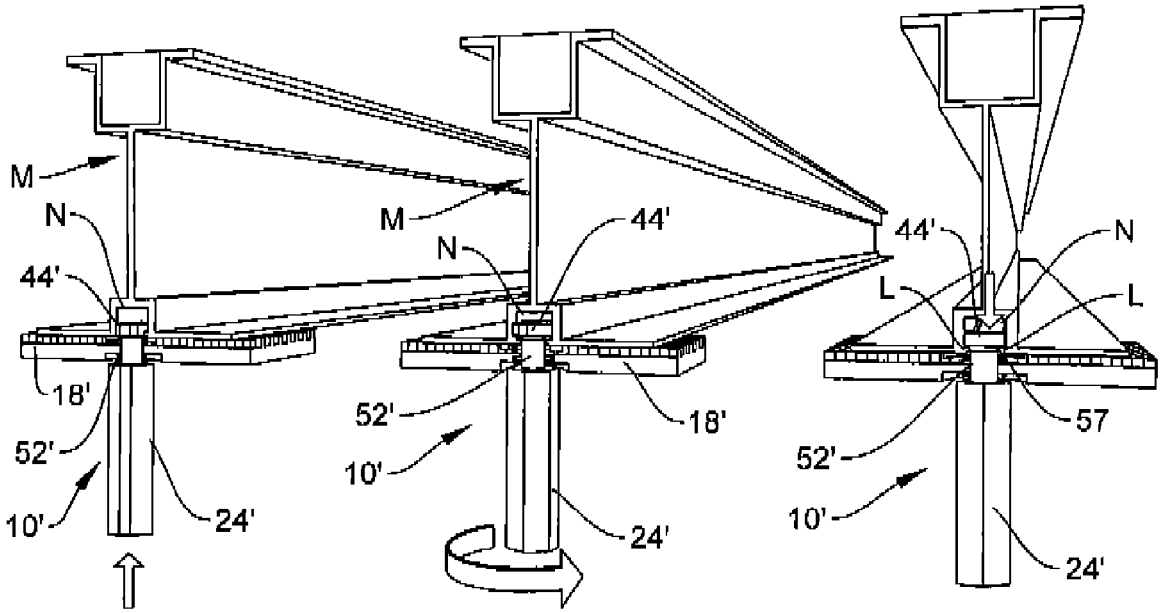
FIGS. 14(A), 14(B) and 14(C) show the adjustable top plate device of FIG. 9 mounted to a beam in respective pivot positions.

In an embodiment, the user connects the device 10' to the beam by first pivoting the head 44' in a position that allows it to be inserted within the notch N of the beam M as shown in FIG. 14(A). The user then pivots the insert body 24' which acts as a handle for the protrusion head 44' as shown in FIG. 14(B) to position the underside edge 78 of the head 44' above the shoulders S. Finally, the user released the handle body 24' and allows the edge 78 of the protrusion head 44' to fall onto the shoulders S and rest thereon as shown in FIG. 14(C). The user will then position the jack posts 12 by inserting the insert body 24' into the rods 13. As shown, the plate member 18' engages the wing-plates G of the beam M.

As shown in FIGS. 10 and 14, a stopper 57 is positioned between the head 44' an the neck portion 52' which stops the neck portion 52' from rotating when in the position in FIG. 14(C) as it will engage the free edges of the shoulder S and thus the user would have to lift the coupled protrusion 22' and sleeve 24'.

Figure 15:
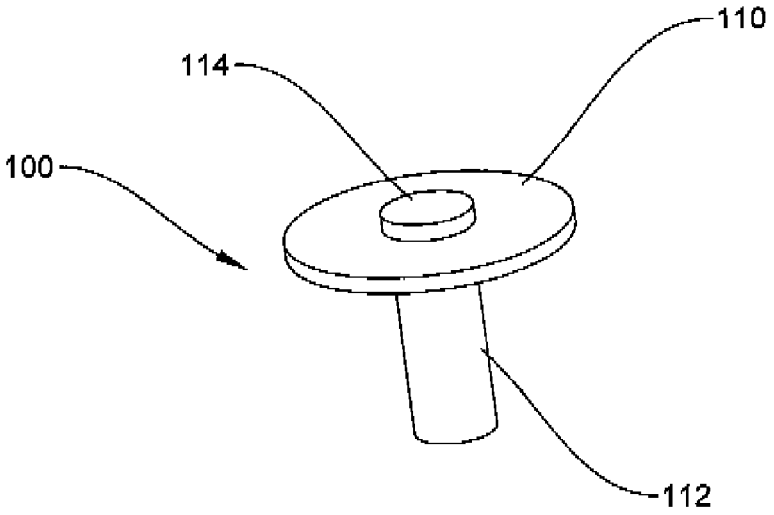
FIG. 15 is a perspective top view and side view of an adjustable top plate device for a jack post in accordance with still another non-restrictive illustrative embodiment of the present disclosure.

FIG. 15 shows an adjustable top plate device 100 comprising a plate member 110 and an insert body 112 extending thereunder. The device 100 is one integral single piece made of deformable, flexible and resilient material. The plate member 110 comprises a circular configuration with a circular protrusion 114 at the central portion thereof.

Figure 16:
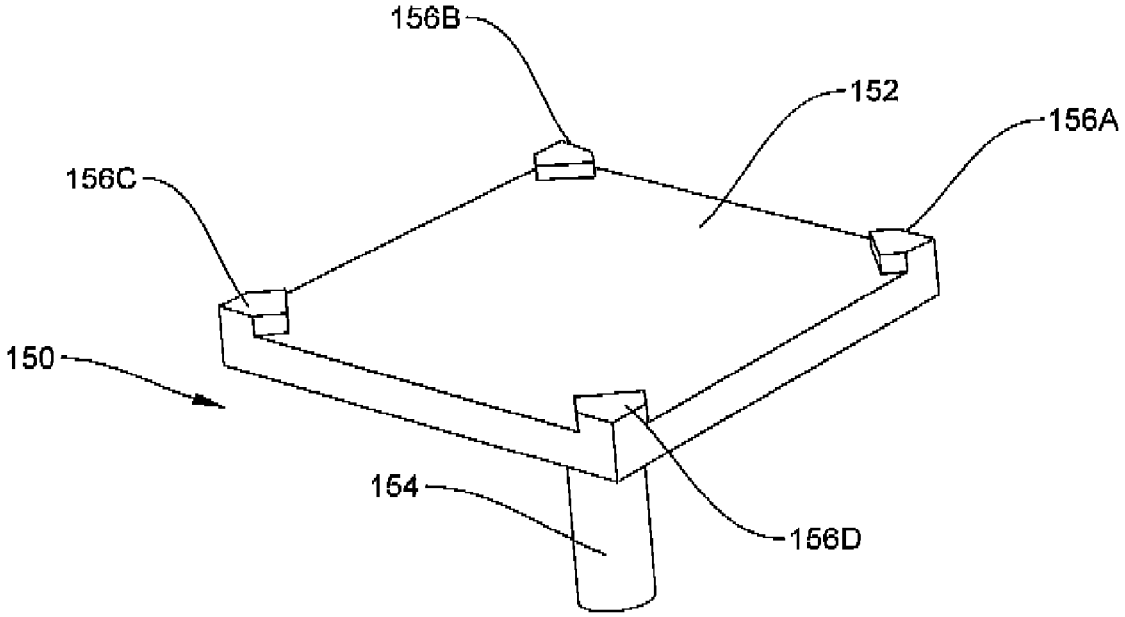
FIG. 16 is a perspective top view and side view of an adjustable top plate device for a jack post in accordance with a further non-restrictive illustrative embodiment of the present disclosure.

FIG. 16 shows an adjustable top plate device 150 comprising a plate member 152 and an insert body 154 extending thereunder. The device 150 is one integral single piece made of deformable, flexible and resilient material. The plate member 152 comprises a rectangular configuration with triangular protrusions 156A, 156B, 156C, 156D at each corner thereof.

Figure 17:
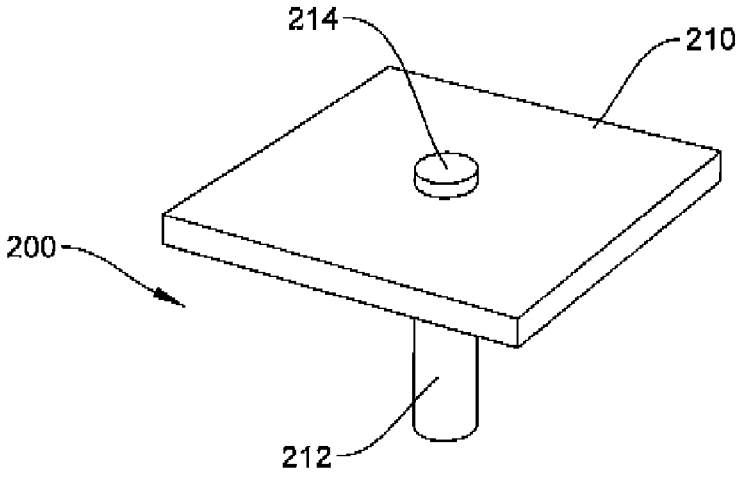
FIG. 17 is a perspective top view and side view of an adjustable top plate device for a jack post in accordance with still a further non-restrictive illustrative embodiment of the present disclosure.

FIG. 17 shows an adjustable top plate device 200 comprising a plate member 210 and an insert body 212 extending thereunder. The device 200 is one integral single piece made of deformable, flexible and resilient material. The plate member 210 comprises a rectangular configuration with a circular protrusion 214 at the central portion thereof.

Figure 18:
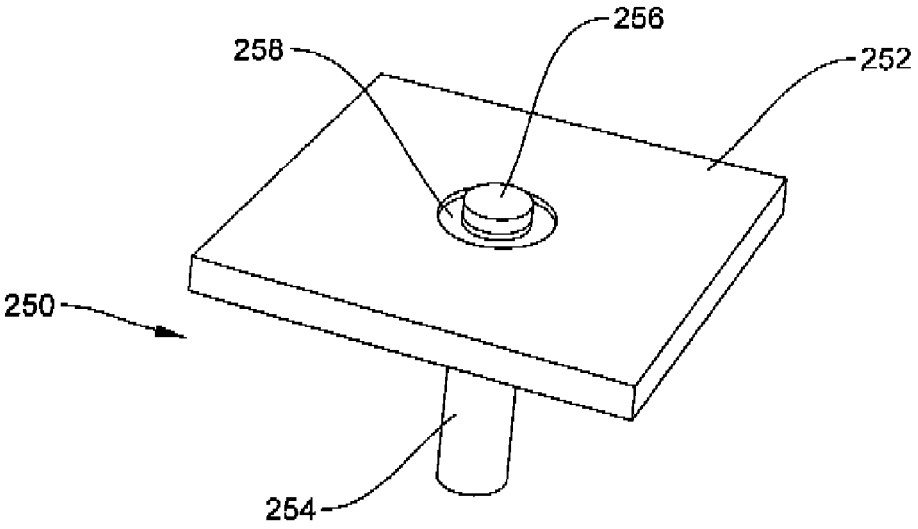
FIG. 18 is a perspective top view and side view of an adjustable top plate device for a jack post in accordance with yet another non-restrictive illustrative embodiment of the present disclosure.

FIG. 18 shows an adjustable top plate device 250 comprising a plate member 252 and an insert body 254 extending thereunder. The device 250 is one integral single piece made of deformable, flexible, and resilient material. The plate member 252 comprises a rectangular configuration with a circular protrusion 256 at the central portion thereof circumscribed by a circular recessed area 258.

Figure 19:
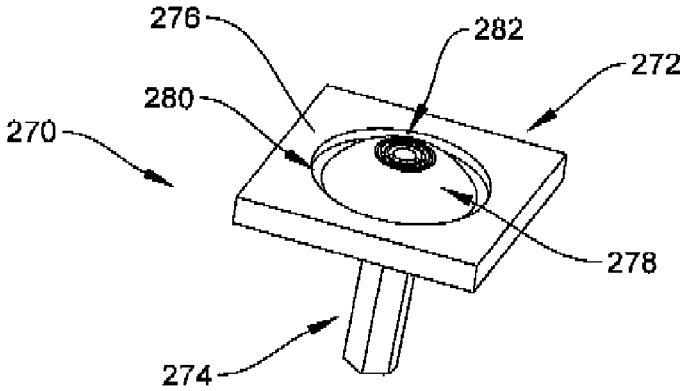
FIG. 19 is a perspective top and side view an adjustable top plate device for a jack post in accordance with yet a further non-restrictive illustrative embodiment of the present disclosure.
Figure 20:
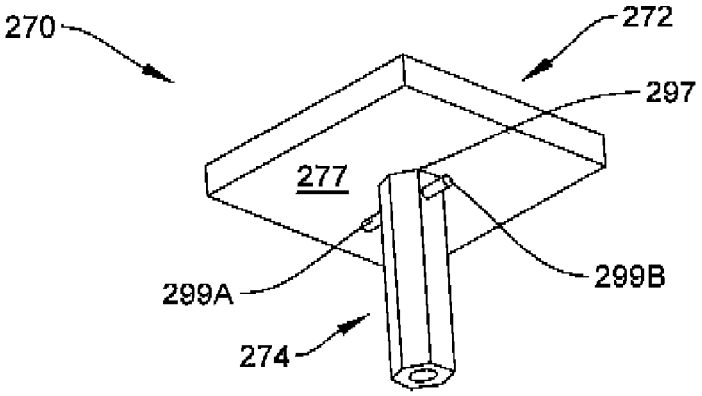
FIG. 20 is a bottom and side perspective view of the adjustable top plate device of FIG. 19.
Figure 21:
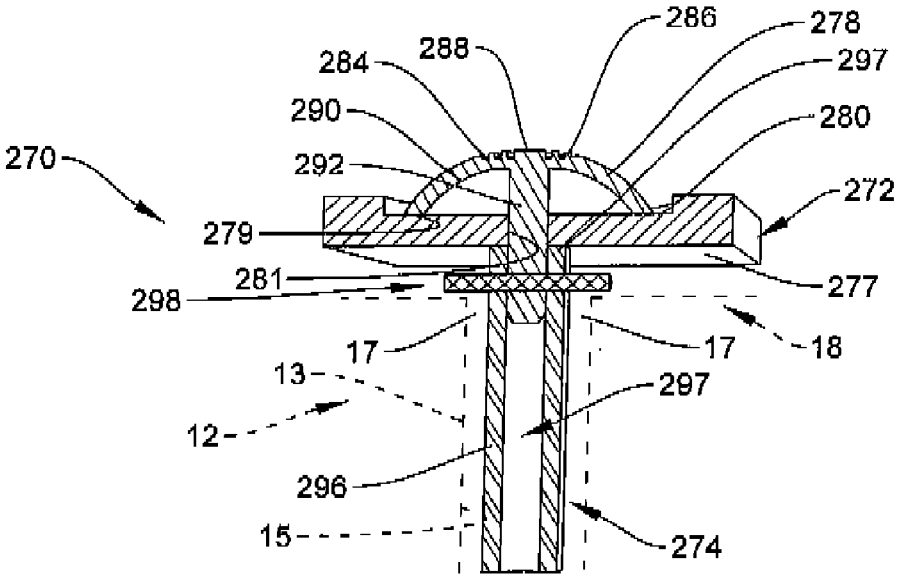
FIG. 21 is a lateral sectional view of the adjustable top plate device of FIG. 19.
Figure 22:
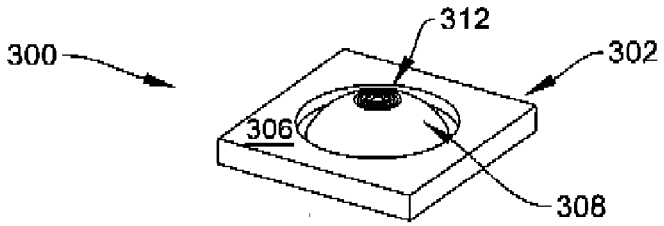
FIG. 22 is a perspective top and side view an adjustable top plate device for a jack post in accordance with still yet another non-restrictive illustrative embodiment of the present disclosure.
Figure 23:
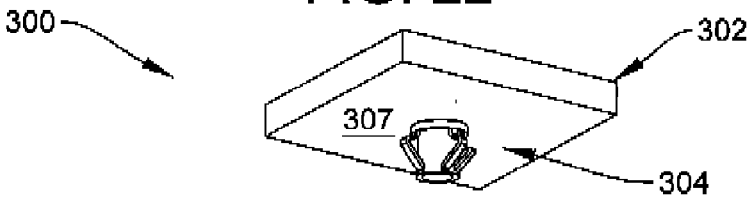
FIG. 23 is a bottom and side perspective view of the adjustable top plate device of FIG. 22.
Figure 24:
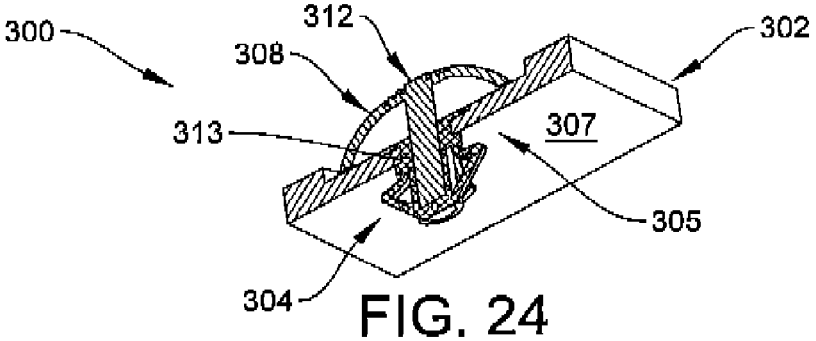
FIG. 24 is a bottom, perspective sectional view of the adjustable top plate device of FIG. 22.
Figure 25:
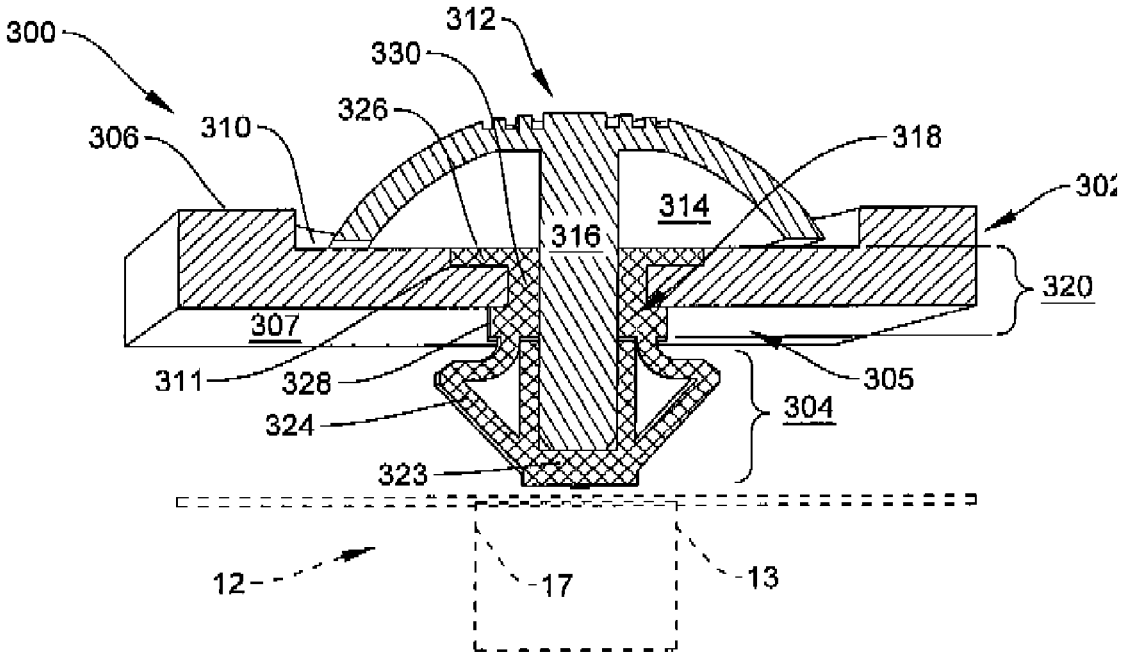
FIG. 25 is a lateral sectional view of the adjustable top plate device of FIG. 22.

With reference to FIGS. 19 to 21, there is shown an adjustable top plate device 270 made of deformable, flexible and resilient material and comprising a plate member 272 and an insert body 274 extending thereunder. The plate member 272 comprises a rectangular configuration having a smooth non-grooved top surface 276 with a central circular protrusion 278 circumscribed by a circular recessed area 280 relative to the rest of the surface 276. The protrusion 278 comprises a bubble or dome like configuration with a top circular engagement portion 282 having grooves 284 defining ridges 286 therebetween and a central flat surface 288. The grooves 284 allowing for trapping air and/or for to release humidity. The dome like protrusion 278 is hollow defining an inner surface 290 from which a stem body 292 downwardly extends. The recessed area 280 defines a hole 281 for allowing the stem body 292 to extend therethrough. The protrusion 278 is a separate body from the plate member 272 and defines a bottom edge 279 resting on the recessed area 280.

The insert body 274 is a hollow sleeve providing a tunnel 294 circumscribed by a wall 296 to receive the stem body 292 therein when assembling the device 270. The stem body 292 is fastened to the insert body 274 when therein via a deformable and resilient elongated fastener 298 that is pierced through the wall 296 of the insert body and the stem body 292 locking the plate member 272 and the insert body 274 together. The fastener 298 has both ends thereof laterally extending from the insert body and defining deformable, flexible, and resilient arms 299A and 299B.

When the top plate device 270 is mounted to a jack post 12, the insert body 274 is inserted within the tubular rod 13 along with the arms 299A and 299B which are inwardly bent along the insert body 274 to slide therein and frictionally pushing against the inner surface 15 of the rod 13 to for a tight friction fit to maintain the top plate device 270 connected to the jack 12. The top plate device 270 is pushed into the rod 13 until the undersurface 277 of the plate member 272 engages the plate member 18 to rest thereon. It should be noted that the flexibility of the fastener 298 allows to pull the separate dome-like or convex protrusion 278 upwardly from the recessed area 280 it rests on pulling the stem body 292 upwardly along with it and exposing an opening between the plate member undersurface 277 and the top edge rim 297 of the insert body 274 in order to clamp a shoulder piece 17 therebetween extending inwardly from the inner surface 15 of the rod 13. Indeed, not all jack post rods 13 have such shoulder pieces and thus there will be no clamping in these cases.

With reference to FIGS. 22 to 25, there is shown an adjustable top plate device 300 comprising a plate member 302 and an insert body 304 extending thereunder. The plate member 302 comprises a rectangular configuration having a smooth, flat, non-grooved top surface 306 with a central circular protrusion 308 and defining an undersurface 307 thereof. The surface 306 defines a recessed central area 310 which includes a further recessed area section 311 including a hole 313.

The central circular dome-like convex and hollow protrusion 308 is an independent and separate piece similar to protrusion 278 discussed above and defines a bottom edge 309 resting on the recessed area 310. Protrusion 308 has a top circular engagement portion 312 similar to portion 282 and thus need not be described any further for concision purposes only. The dome-like protrusion 308 has an inner surface 314 with a stem body 316 downwardly extending therefrom.

The insert body 304 is a bottom section of a clip member 305 which positioned through the hole 311 of the plate member 302 to be connected thereto.

The clip member 305 includes a central section 318 for receiving the stem body 316 therethrough. The central section 318 defines a top connector part 320 for being connected to the plate member 302 and a bottom insert connector part 304 for being connectively inserted within the jack post 12. Thus, the insert body 304 is bottom insert connector part of the clip member 305. Outer flexible and resilient wings 324 radially extending from the bottom connector part 322. These wings 324 provide connectively clipping the top plate device 300 to the jack post 12.

The top connector part 320 includes upper and lower circular flanges 326 and 328 respectively defining a median section 330 therebetween which provides a circular channel 332 therebetween. This median section 330 is positioned through the hole 313 with the upper flange 326 resting on recessed section 311 of the plate member 302 and the lower flange 328 engaging the undersurface 307 of the plate member 302. The central section 318 is tubular and receives the stem body 316 which is adhesively connected to the bottom end 323 of the insert body 304. The wings 324 are thus positioned beneath the undersurface 307. Thus, when the insert body 304 is fitted within the rod 13 of the jack post 12, the wings 324 flatten to allow insertion and outwardly extend to frictionally engage the inner surface 15 for a clip-like fit therewith.

Figure 26:
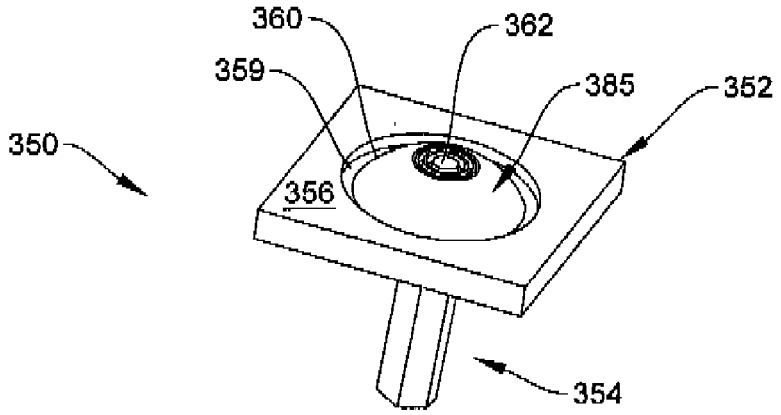
FIG. 26 is a perspective top and side view an adjustable top plate device for a jack post in accordance with still yet a further non-restrictive illustrative embodiment of the present disclosure.
Figure 27:
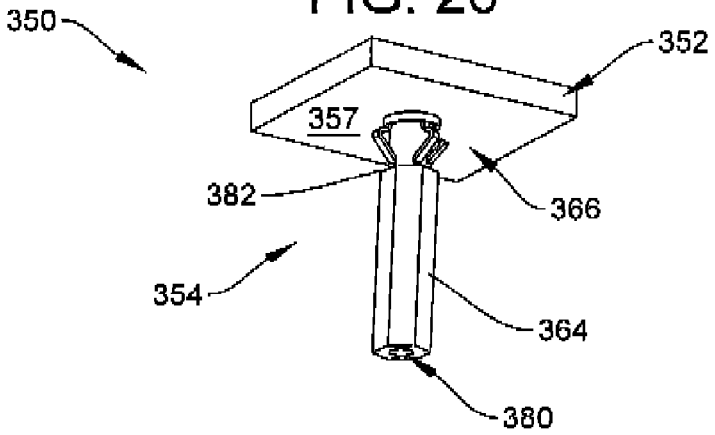
FIG. 27 is a bottom and side perspective view of the adjustable top plate device of FIG. 26.
Figure 28:
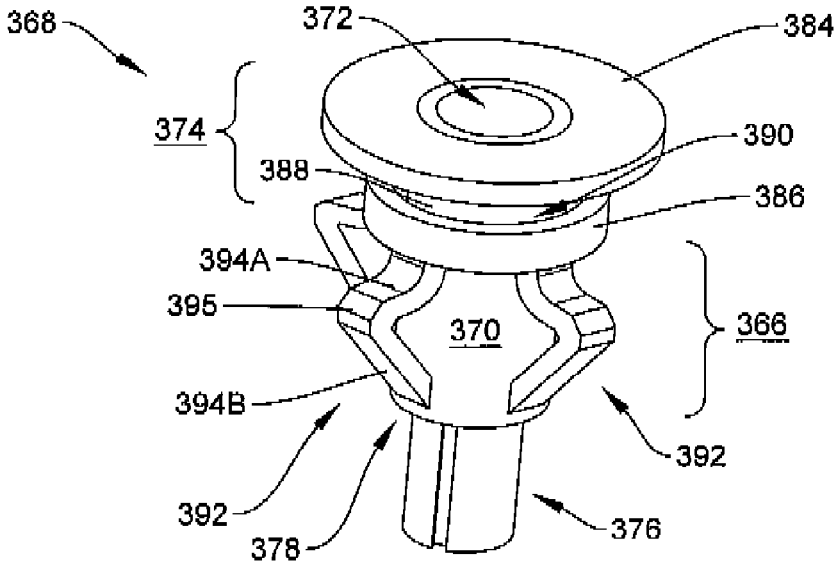
FIG. 28 is a top and side perspective view of the clip member of the adjustable top plate device of FIG. 26 in accordance with a non-restrictive illustrative embodiment of the present disclosure.

With reference to FIGS. 26 to 28, there is shown an adjustable top plate device 350 comprising a plate member 352 and an insert body 354 extending thereunder. The plate member 352 comprises a rectangular configuration having a smooth, flat, non-grooved top surface 356 with a central circular protrusion 358 and defining an undersurface 367 thereof. The surface 356 defines a recessed central area 360 which includes a central hole (not shown). Indeed, the plate member 352 is similar to plate member 302 described above.

The central circular dome-like convex and hollow protrusion 358 is similar to protrusion 308 described above and as such is an independent and separate defining a bottom edge 359 resting on the recessed area 360. Protrusion 358 has a top circular engagement portion 362 similar to portion 312 previously described. Although not shown and as s per the structure of protrusion 308, protrusion 358 is also hollow defining an inner surface 314 with a stem body downwardly extending therefrom that is inserted within the insert body 354.

The insert body 354 is a combination of a main lower insert body 364 and an upper insert body 366. The main lower insert body 364 is similar to insert body 274 described above and the upper insert body 366 forms part of a clip member 368 that is similar to the clip member 305 described above.

The clip member 368 includes a central tubular section 370 defining a channel 372 for receiving the stem body therethrough. The central tubular section 370 defines a top connector part 374 for being connected to the plate member 352 and a bottom connector part which defines the upper insert body 366. A bottom insert tube 376 downwardly extends from the bottom connector part 366 of the central tubular section 370 forming a shoulder 378 therebetween. The insert tube 376 provides being fittingly inserted within the tunnel 380 of the main lower insert body 364 until the shoulder 378 engages the top rim 382 of main lower insert body 364. The top connector part 374 is similar to the top connector part 320 of clip member 305 and as such includes upper and lower circular flanges 384 and 386 respectively defining a median section 388 therebetween which provides a circular channel 390 therebetween. Thus the top connector part 374 is connected to the plate member 352 in a similar fashion the connection of the top connector part 320 and the plate member 302 described above.

Like clip member 305, clip member 368 also includes wings 392 radially extending from the central section 370 beneath the lower flange 386 and above the shoulder 378 such that when the plate member 352, the clip member 368 and the main lower insert body 364 are assembled for use, the wings 392 are exposed between the plate member 352 and the main lower insert body 364. Indeed, the wings 392, like the wings 324 and the arms 299A and 2996 are non-limiting examples of outwardly extending and outwardly biased flexible and resilient members for frictionally engaging the inner surface 15 of the jack post rods 13 for a releasable wedge-like connection therewith. In this non-limiting example, each wing 392 has an angular bracket or c-shape like configuration with upper and lower diagonally and radially extending arm parts, 394A and 394B, respectively, meeting at a common elbow 395. Therefore, the complete insert body 354 is inserted within the jack post rod 13 causing the elbow 395 to pushed or squeezed inwardly (flattening the angular C-shaped wing) by the inner surface 15 and the outwardly resilient biasing force of the wing pushes against the inner surface providing for the friction or wedge-like fit.

Further non-limiting examples of clip members combined with main insert bodies to provide of outwardly extending and outwardly biased flexible and resilient members for frictionally engaging the inner surface 15 of the jack post rods 13 for a releasable wedge-like connection therewith will be described further below.

Figure 29:
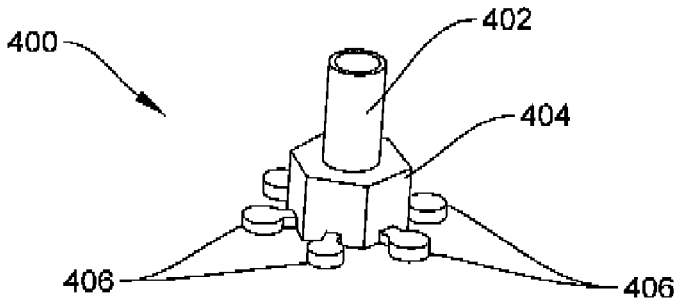
FIG. 29 is a top and side perspective view of a clip member for an adjustable top plate device in accordance with another non-restrictive illustrative embodiment of the present disclosure.

With reference to FIGS. 29 and 28, there is shown a clip member 400 that comprises a top tubular member 402 and base section 404 and rounded flexible and resilient fins 406 radially extending therefrom. The tubular member 402 can provide for receiving stem bodies as described herein for adjustable top plate devices provided herein including without limitation devices 10, 10', 270, 300 and 350. The base section 404 is positioned on a lower main insert body portion 408 of an adjustable top plate device 410 and thus the base section 404 provides a space between the plate member 412 of device 410 and the fins 406. The base section 404 defines an upper insert body portion which together with portion 408 define the insert body 414 that is fully inserted within a jack post rod 13 providing for the fins 406 to bend inwardly against the inner surface 15 and push outwardly due to their biasing force for providing a friction fit as previously explained.

Figure 30:
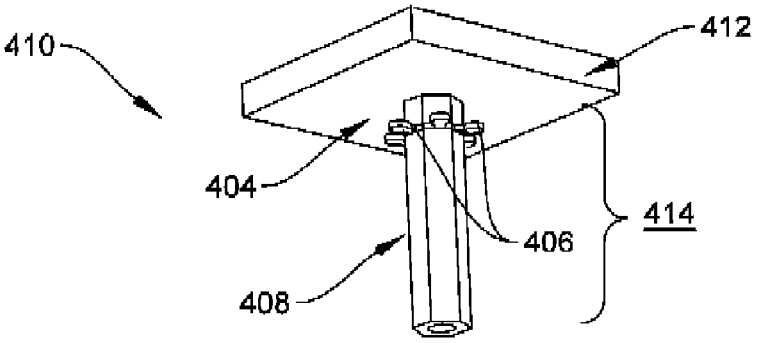
FIG. 30 is a bottom and side perspective view of an adjustable top plate device in with the clip member of FIG. 29.
Figure 31:
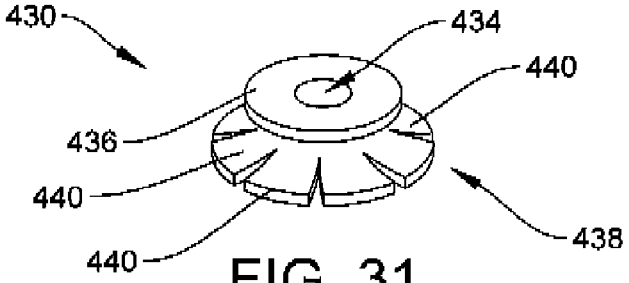
FIG. 31 is a top and side perspective view of a clip member for an adjustable top plate device in accordance with a further non-restrictive illustrative embodiment of the present disclosure.
Figure 32:
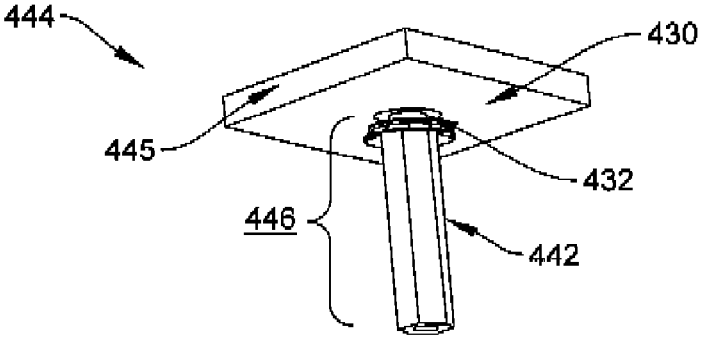
FIG. 32 is a bottom and side perspective view of an adjustable top plate device in with the clip member of FIG. 31.

With reference to FIGS. 30 and 31, there is shown a clip member 430 that comprises a central tubular section 432 defining a tunnel 434 with a top part 436 in the form of a disc and lower part 438 in the form of a cut out disc defining and rounded flexible and resilient flaps 440 radially and slightly downward extending therefrom. The tubular section 432 can provide for receiving stem bodies as described herein for adjustable top plate devices provided herein including without limitation devices 10, 10', 270, 300 and 350. The lower part 438 is positioned on a lower main insert body portion 442 of an adjustable top plate device 444 having a plate member 445. The top and lower parts 436 and 438 are spaced apart. The lower part 438 is an upper insert body portion which together with portion 442 define the insert body 445 that is fully inserted within a jack post rod 13 providing for the flaps 440 to bend inwardly against the inner surface 15 and push outwardly due to their biasing force for providing a friction fit as previously explained.

Figure 33:
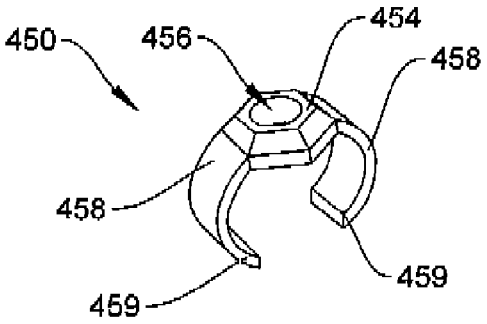
FIG. 33 is a top and side perspective view of a clip member for an adjustable top plate device in accordance with yet another non-restrictive illustrative embodiment of the present disclosure.
Figure 34:
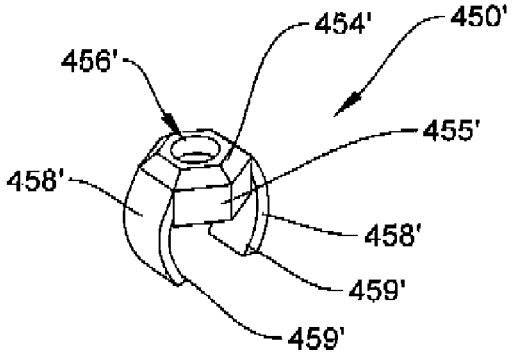
FIG. 34 is a top and side perspective view of a clip member for an adjustable top plate device in accordance with yet a further non-restrictive illustrative embodiment of the present disclosure.
Figure 35:
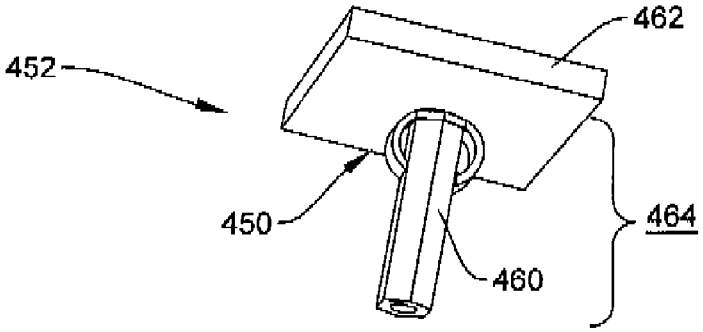
FIG. 35 is a bottom and side perspective view of an adjustable top plate device in with the clip member of FIG. 33.

FIGS. 33 and 34 respectively show similar clip member and 450 and 450' for being mounted to an adjustable plate device 452 shown in FIG. 35. Clip member 450 includes a central body portion 454 that defines a central hole 456 and has a pair of curved c-shaped wings 458 laterally and downwardly extending therefrom defining respective bottom free ends 459. Similarly, clip member 450' includes a central body portion 454' that defines a central hole 456; and has a pair of curved c-shaped wings 458, laterally and downwardly extending therefrom defining respective bottom free ends 459'. The central body portion 454' also has a lower part 455' that extends between the c-shaped wings 458' providing a thicker body portion 454' relative to portion 454 provide for receiving stem bodies as described herein for adjustable top plate devices provided herein including without imitation devices 10, 10', 270, 300 and 350. The central body portion 454 and 454' are mounted on top of a lower main insert body portion 460 of the device 452 defining a space between the plate member 452 and the wings 458 (or 458'). The central body portion 454 or 454 which together with portion 460 define the insert body 464 that is fully inserted within a jack post rod 13 providing for the wings 458 or 458' to flatten when squeezed against the inner surface 15 providing the free ends 459 to slide along the outer surface of the body portion 460. The flattened wings 458 resiliently push outwardly against the inner surface 15 due to their biasing force for providing a friction fit as previously explained.

Figure 36:
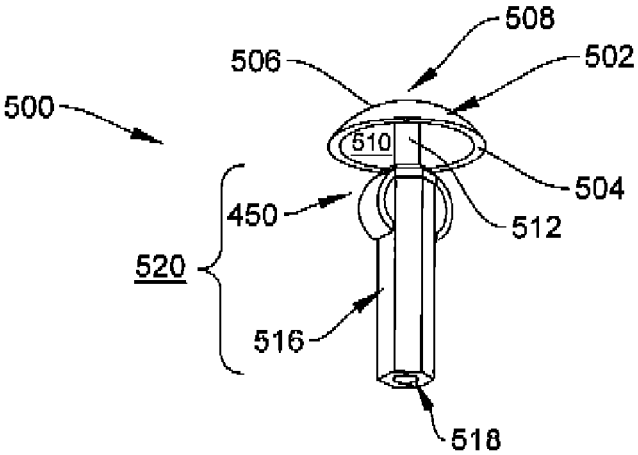
FIG. 36 is a perspective top and side view an adjustable top plate device for a jack post in accordance with yet still another non-restrictive illustrative embodiment of the present disclosure.

With reference to FIG. 36, there is shown an adjustable top plate device 500 in accordance with another non-limiting illustrative embodiment of the present disclosure. In this example, the device 500 includes a hollow dome-like flexible and resilient structure 502 defining a bottom flat free end 504 that defines the plate member. The dome-shaped outer body 506 of the structure 502 extends from this plate member upwardly towards a central summit 508 (similarly to the dome-like protrusion described above) thus defining the protrusion. The dome-shaped outer body 506 defines an inner concave surface 510 with a stem body 512 extending therefrom that is inserted within the hole 456 of the clip member 450 and into the tunnel 514 of the lower insert body portion 516 which is similar to the sleeve 24 discussed above for example. The stem body 512 may be adhesively connected to the central body portion 456 and to the lower insert body 516 in order to provide the assembled device 500. As such, the clip member 450 and the lower insert body portion 516 form the insert body 520 that is fitted within the jack post rod 13 with the circular free end 504 resting directly on the top plate 18 of the jack post 12 or hovering right above and very close to the top plate 18.

Figure 37:
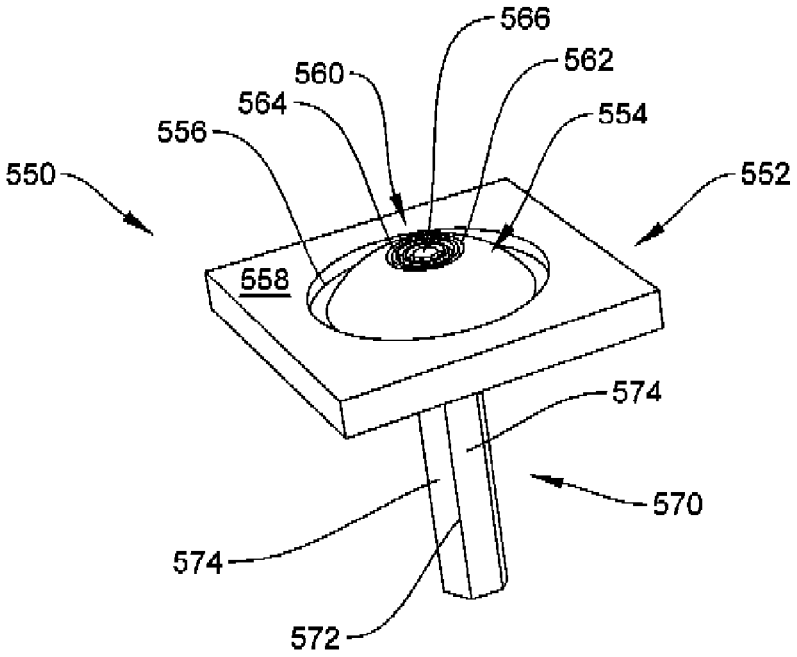
FIG. 37 is a perspective top and side view an adjustable top plate device for a jack post in accordance with yet still a further non-restrictive illustrative embodiment of the present disclosure.

Turning now to FIG. 37 there is shown an adjustable top plate device 550 including a plate member 552 with a central dome like protrusion 554 extending from a circular recessed portion 556 of the top surface 558. The protrusion 554 has a central top engaging portion 560 at its summit with circular grooves 562 defining circular ridges 564 therebetween providing for a friction contact with a surface. The central top engaging portion 560 includes a central circular core part 566. This part 566 may be upwardly movable and upwardly biased by an underlying biasing member such as stem body or a spring. Alternatively, the device 500 is a single piece of flexible and resilient material. The dome like protrusion 554 may be full or hollow. In some cases, when the dome 554 it is full it is made of sponge-like material to be easily malleable. The device 550 also includes an insert body 570 downwardly extending form the plate member 552. The insert body 570 is polygonal in shape forming corners 572 between meeting flat sides 574. As the insert body 570 is made of flexible and resilient material, the corners 572 provide for a snug contact fit with the inner surface 15 of the jack post rod 13. Indeed, the insert body may also include outwardly extending and outwardly biased flexible and resilient members such as wings, arms, fins, flaps and the like for additional snug and friction contact fit with the inner surface 15.

Figure 38:
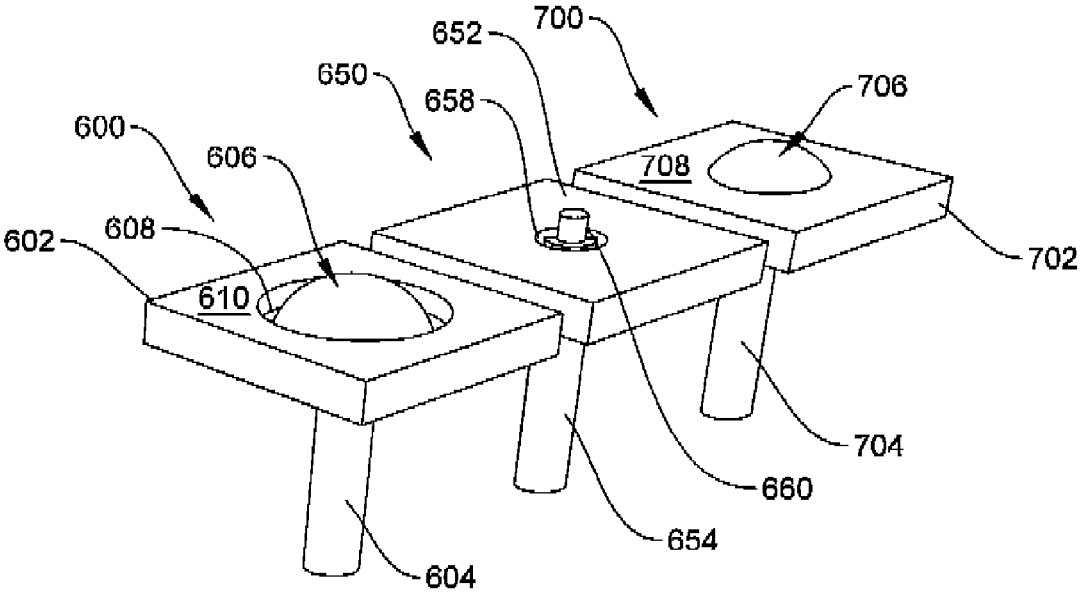
FIG. 38 is a perspective top and side view three adjustable top plate device for a jack post in accordance with respective non-restrictive illustrative embodiments of the present disclosure.

Turning to FIG. 38, there is shown adjustable top plate device 600, 650 and 700.

Device 600 includes a plate member 602 with a tubular insert body 604 extending thereunder. A dome-like protrusion 606 upwardly extends from a recessed portion 608 formed within the top surface 610 of the plate member 602, the rest of the top surface 610 being otherwise smooth without grooves or ridges. The full outer side of the protrusion 606 is smooth without grooves or ridges. The device 600 may be an assembly or part or be made of a single flexible and resilient piece. The dome protrusion 606 may be hollow or full. In the case of it being hollow, the protrusion may be supported by an underlying biasing element. The insert body 604 may also include outwardly extending and outwardly biased flexible and resilient elements or members along the length thereof or on any portion thereof.

Device 650 includes a plate member 652 and an insert body 654. The top surface 656 of the plate member 652 has a recessed area 658 with a tubular rod-like protrusion 660 extending therefrom which is made of flexible and resilient material and which can be upwardly biased by an underlying biasing member such as a stem body, a spring, and the like.

Device 700 is similar to the device 600 including a plate member 702 and an insert body 704 with a dome like protrusion 706 extending upwardly from the top surface 708 of the plate member 702. There is no recessed portion here. The dome like protrusion 706 may be filled with material or be hollow or can be supported by an inner biasing element. Device 700 may be a single integrated piece of flexible and resilient material or an assembly of parts.

The insert bodies 654 and 704 are similar to insert body 604 and are shown to be tubular rather than polygonal and may include outwardly extending and biasing elements or members as discussed and exemplified herein.

The various features described herein can be combined in a variety of ways within the context of the present disclosure so as to provide still other embodiments. As such, the embodiments are not mutually exclusive. Moreover, the embodiments discussed herein need not include all of the features and elements illustrated and/or described and thus partial combinations of features can also be contemplated. Furthermore, embodiments with less features than those described can also be contemplated. It is to be understood that the present disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation. Hence, although the present disclosure has been provided hereinabove by way of non-restrictive illustrative embodiments thereof, it can be modified, without departing from the scope, spirit and nature thereof and of the appended claims.

What is claimed is:

1. An adjustable top plate device for a jack post for supporting a top structure when positioned on a floor structure, the jack post having a telescoping rod and sleeve, the rod including a top plate and an opening extending therein, the adjustable top plate device comprising:

a plate member defining a top surface for interfacing with the top structure and an opposite undersurface for engaging the top plate of the rod;

at least one protrusion protruding from the top surface of the plate member for engaging the top structure, the at least one protrusion comprising deformable and resilient material; and an insert body extending beneath the undersurface of the plate member for being inserted in the opening of the rod, wherein the protrusion is movable relative to the plate member and the plate member defining a hole for movably positioning the protrusion therethrough, wherein when the adjustable top plate device is mounted to the jack post, the insert body is inserted within the opening of the rod and the undersurface of the plate member engages the top plate of the rod.

2. An adjustable top plate device according to claim 1, wherein the protrusion is biased outwardly relative to the pate member via a biasing member.

3. An adjustable top plate device according to claim 1, wherein the protrusion comprises:

a protrusion head positioned above the top surface of the plate member;

a neck portion downwardly extending from the protrusion head through the hole; and a stem body downwardly extending from the neck portion into the insert body;

wherein the neck portion is loosely positioned within the providing for selectively imparting a pivotable, upward, and downward movement thereto within the hole.

4. An adjustable top plate device according to claim 1, wherein the plate member comprises flexible portion defining the hole.

5. An adjustable top plate device according to claim 1, wherein the flexible portion comprises bubble configuration comprising a convex part at the top surface of the plate member, a concave part at the undersurface of the plate member and a void therebetween.

6. An adjustable top plate device according to claim 1, wherein the convex and concave parts comprise deformable and resilient material.

7. An adjustable top plate device according to claim 4, wherein the flexible portion is circumscribed by a recessed area formed in the plate member.

8. An adjustable top plate device according to claim 3, wherein top structure comprises a beam defining a notch with shoulder extending therein, the protrusion head comprising an oblong structure and being pivotable between a position providing a clearance for entering the notch and another position providing for an underside of the protrusion head to rest on the shoulders.

9. An adjustable top plate device for a jack post for supporting a top structure when positioned on a floor structure, the jack post having a telescoping rod and sleeve, the rod including a top plate and an opening extending therein, the adjustable top plate device comprising:

a plate member defining a top surface for interfacing with the top structure and an opposite undersurface for engaging the top plate of the rod;

at least one protrusion protruding from the top surface of the plate member for engaging the top structure, the at least one protrusion comprising deformable and resilient material; and an insert body extending beneath the undersurface of the plate member for being inserted in the opening of the rod, wherein the protrusion comprises a dome-like shape, wherein when the adjustable top plate device is mounted to the jack post, the insert body is inserted within the opening of the rod and the undersurface of the plate member engages the top plate of the rod.

10. An adjustable top plate device according to claim 9, wherein the protrusion is a separate member having a bottom edge thereof resting on the top surface of the plate member.

11. An adjustable top plate device according to claim 9, wherein the protrusion comprises an outer surface thereof and flexible and resilient material underlying the outer surface thereof.

12. An adjustable top plate device according to claim 9, wherein the protrusion is hollow defining an inner surface having a stem body extending therefrom for being fitted within the insert body via a hole formed in the plate member.

13. An adjustable top plate device according to claim 9, wherein the dome-like shape comprises a summit defining a surface contacting area, wherein the surface contacting area comprises an additional protruding element being movable relative the dome-like protrusion.

14. An adjustable top plate device for a jack post for supporting a top structure when positioned on a floor structure, the jack post having a telescoping rod and sleeve, the rod including a top plate and an opening extending therein, the adjustable top plate device comprising:

a plate member defining a top surface for interfacing with the top structure and an opposite undersurface for engaging the top plate of the rod;

at least one protrusion protruding from the top surface of the plate member for engaging the top structure, the at least one protrusion comprising deformable and resilient material; and an insert body extending beneath the undersurface of the plate member for being inserted in the opening of the rod, wherein the rod defines an inner surface circumscribing the opening, the insert body being in a snug contact fit with the inner surface when positioned within the opening, wherein when the adjustable top plate device is mounted to the jack post, the insert body is inserted within the opening of the rod and the undersurface of the plate member engages the top plate of the rod.

15. An adjustable top plate device for a jack post for supporting a top structure when positioned on a floor structure, the jack post having a telescoping rod and sleeve, the rod including a top plate and an opening extending therein, the adjustable top plate device comprising:

a plate member defining a top surface for interfacing with the top structure and an opposite undersurface for engaging the top plate of the rod;

at least one protrusion protruding from the top surface of the plate member for engaging the top structure, the at least one protrusion comprising deformable and resilient material; and an insert body extending beneath the undersurface of the plate member for being inserted in the opening of the rod, wherein the rod defines an inner surface circumscribing the opening, wherein the insert body comprises outwardly extending and outwardly biased deformable, flexible and resilient members for being in a frictional contact fit with the inner surface, wherein when the adjustable top plate device is mounted to the jack post, the insert body is inserted within the opening of the rod and the undersurface of the plate member engages the top plate of the rod.

16. An adjustable top plate device according to claim 15, wherein the insert body comprises a clip member comprising the outwardly extending and outwardly biased deformable, flexible, and resilient members.

17. An adjustable top plate device for a jack post for supporting a top structure when positioned on a floor structure, the jack post having a telescoping rod and sleeve, the rod including a top plate and an opening extending therein, the adjustable top plate device comprising:

a plate member defining a top surface for interfacing with the top structure and an opposite undersurface for engaging the top plate of the rod;

at least one protrusion protruding from the top surface of the plate member for engaging the top structure, the at least one protrusion comprising deformable and resilient material; and an insert body extending beneath the undersurface of the plate member for being inserted in the opening of the rod, wherein when the adjustable top plate device is mounted to the jack post, the insert body is inserted within the opening of the rod and the undersurface of the plate member engages the top plate of the rod, wherein a biasing element connects the plate member to the insert body providing a biasing force for mutually engagement therebetween, the plate member and the insert body being separate bodies movable from each other against the biasing force of the biasing element to provide a space therebetween.

18. An adjustable top plate device according to claim 17, wherein the rod defines an inner surface circumscribing the opening, wherein a portion of the inner surface inwardly protrudes into the opening, the plate member and the insert body providing for clamping the inner surface portion when fitted in the space therebetween due to the biasing force.

* * * * *